US007050360B2

(12) United States Patent
Saito

(10) Patent No.: US 7,050,360 B2
(45) Date of Patent: May 23, 2006

(54) WRIST WATCH WITH VIBRATION FUNCTION

(75) Inventor: Masaru Saito, Tokyo (JP)

(73) Assignee: Kabushiki-Kaisya Tokyo Shinya, Tokyo (JP)

( * ) Notice: Subject to any disclaimer, the term of this patent is extended or adjusted under 35 U.S.C. 154(b) by 224 days.

(21) Appl. No.: 10/387,945

(22) Filed: Mar. 13, 2003

(65) Prior Publication Data

US 2003/0179656 A1 Sep. 25, 2003

(30) Foreign Application Priority Data

Mar. 20, 2002 (JP) ..... 2002-077666

(51) Int. Cl.
*G04C 21/00* (2006.01)
*G04B 19/06* (2006.01)
*G04B 25/02* (2006.01)

(52) U.S. Cl. ..... 368/230; 368/250; 368/72

(58) Field of Classification Search ..... 368/230, 368/12, 72–74, 250; 340/407.1, 7.6
See application file for complete search history.

(56) References Cited

U.S. PATENT DOCUMENTS 3,577,876 A * 5/1971 Spadini ..... 368/250
3,973,706 A * 8/1976 Boyce et al. ..... 224/165
4,456,387 A * 6/1984 Igarashi ..... 368/230
5,023,853 A * 6/1991 Kawata et al. ..... 368/230
5,233,572 A * 8/1993 McCarty, Jr. ..... 368/107
5,282,181 A * 1/1994 Entner et al. ..... 368/73
5,361,241 A * 11/1994 Ferrara et al. ..... 368/281
5,365,497 A * 11/1994 Born ..... 368/230
5,367,505 A * 11/1994 Tsuchiya et al. ..... 368/72
5,559,761 A * 9/1996 Frenkel et al. ..... 368/69
5,565,840 A * 10/1996 Thorner et al. ..... 340/407.1
5,663,703 A * 9/1997 Pearlman et al. ..... 340/407.1
5,686,882 A * 11/1997 Giani ..... 340/407.1
5,764,594 A * 6/1998 Berman et al. ..... 368/12
5,878,004 A * 3/1999 Miyauchi et al. ..... 368/230
5,889,737 A * 3/1999 Alameh et al. ..... 368/204
6,052,339 A * 4/2000 Frenkel et al. ..... 368/230
6,158,884 A * 12/2000 Lebby et al. ..... 368/282

FOREIGN PATENT DOCUMENTS

JP 10-319146 * 12/1998

* cited by examiner

*Primary Examiner*—Andrew H. Hirshfeld
*Assistant Examiner*—Leo T. Hinze
(74) *Attorney, Agent, or Firm*—Frishauf, Holtz, Goodman & Chick, P.C.

(57) ABSTRACT

To provide a wrist watch with a vibration function which can more enhance the vibration effect so that even when the user is, for example, sleeping deeply, the vibration function can effectively act on the user. The wrist watch with a vibration function comprises a watch case, a box part formed at an under surface of the watch case, at least one vibration motor received in the box such that a part of the vibration motor projects from the box part, a cover formed of a flexible material and adapted to cover for positioning the vibration motor, a bottom case serving as a lower surface and having a window formed in a part of the bottom case, and a vibration source received in the case and projecting from the window in a loosely fitted state.

4 Claims, 5 Drawing Sheets

WRIST WATCH WITH VIBRATION FUNCTION

BACKGROUND OF THE INVENTION

1. Field of the Invention

The present invention relates to a wrist watch with a vibration function and more particularly to a wrist watch of the type which allows the user to sense a generation of vibrations powerfully and accurately.

2. Related Art

In addition to a clock of the type which is to be placed on the top of furniture including a table, a desk, and the like, a wrist watch with a vibration function was recently developed for personal use, which allows the user to bodily sense the arrival of a preset time, the passage of a preset time, etc. by vibrations instead of or in addition to ringing of an acoustic mechanism.

This vibration function surely allows the user to sense time-related information. It exhibits such an excellent function as to let the user individually and privately know the arrival of time and/or the passage of time in a silent manner and without causing any inconvenience to other persons. This is particularly important when the user is a person having hearing difficulty.

The conventional wrist watch with a vibration function uses a thin battery such as a lithium battery received in a watch case and a vibration motor likewise received in the watch case. The vibration motor vibrates the entire watch case. Due to this arrangement, the conventional wrist watch with a vibration function has such a problem that the force for transmitting vibrations occasionally becomes weak, thus failing to allow the user to sense the time-related information.

The present invention has been accomplished by paying attention to the above status and the above problem inherent in the conventional wrist watch with a vibration function.

SUMMARY OF THE INVENTION

It is, therefore, an object of the present invention to provide a wrist watch with a vibration function capable of solving the above mentioned problem and capable of more enhancing the vibration effect so that vibrations effectively act on the user even when the user are sleeping deeply, for example.

To achieve the above object, according to one aspect of the present invention, there is provided a wrist watch with a vibration function comprising a watch case, a box part formed at a lower surface of the watch case, at least one vibration motor received in the box part such that a part of the vibration motor project therefrom, and a cover formed of a flexible material and adapted to cover for positioning the vibration motor. The box part is preferably formed of a flexible material. Preferably, the cover is provided with a top plate which is formed of the same material as the cover.

It is preferred that two vibration motors are received in the box part in side by side abutment relation It is also preferred that the cover has a generally W-shaped sectional configuration so as to fit to the projecting contours of the two vibration motors which are received in the box part in side by side abutment relation. The flexible material is preferably rubber. Preferably, the wrist watch with a vibration function further comprising a wrist band and a battery as a power source received in the wrist band, the wrist band and the watch case being engaged with each other so that the battery is electrically connected at least to the vibration motor.

According to another aspect of the invention, there is provided a wrist watch with a vibration function comprising a bottom case serving as a lower surface and having a window formed in a part thereof, a case, and a vibration source received in the case and projecting from the window in a loosely fitted state. Preferably, the vibration source is received in a plastic-made case, an upper surface of the vibration source is closed with a silicon rubber-made cushion cover, a lower surface of the case is closed with a silicon rubber-made cushion packing, and an upper surface of the cushion cover case is covered with a metal-made case retainer. The vibration source is preferably attached to a wrist band.

By virtue of the above-mentioned construction, the partly projected vibration motor is, while being cushioned by the cover formed of a flexible material, intimately attached to a target position (user's wrist, etc.) and it transmits vibrations directly thereto. Accordingly, a large effect can be obtained even if the consuming electric power is small. Thus, it is possible for the wrist watch of the present invention to allow the user to fully sense the vibrations even when the user is in an unconscious state, sleeping deeply, for example.

DETAILED DESCRIPTION OF THE PREFERRED EMBODIMENTS

Figure 1:
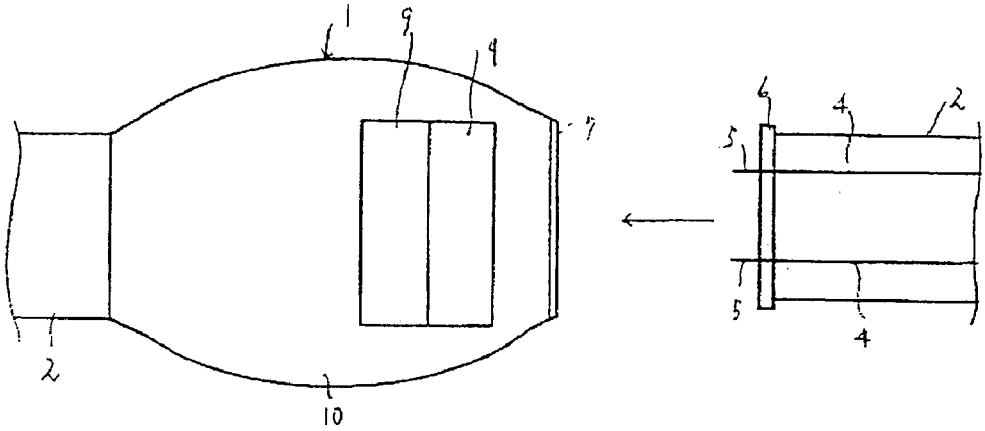
FIG. 1 is a partial rear view showing a connection between a watch case and a wrist band which constitute a wrist watch with a vibration function according to the first embodiment of the present invention.
Figure 2:
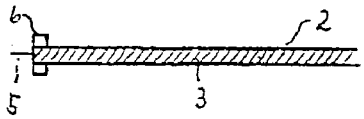
FIG. 2 is a partial side sectional view showing the wrist band.
Figure 3:
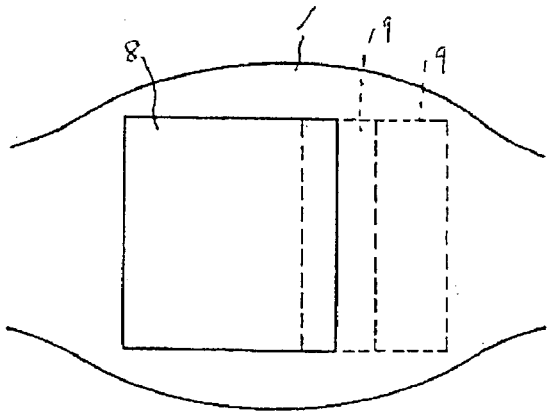
FIG. 3 is an upper surface view showing the watch case.
Figure 4:
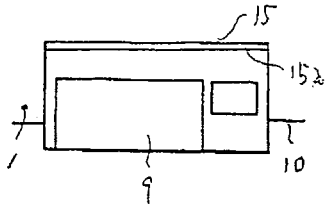
FIG. 4 is a side view showing a vibration motor received in the wrist watch.
Figure 5:
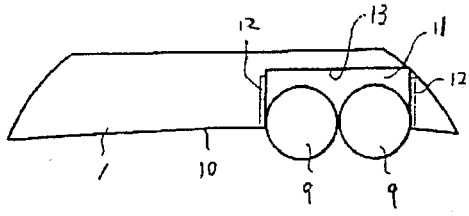
FIG. 5 is a front view showing a positional relation between the watch case and the vibration motor.
Figure 6:
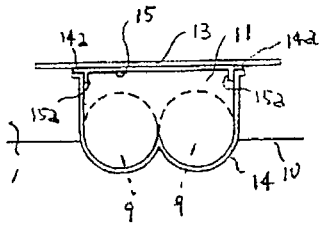
FIG. 6 is a front view showing a cover attaching state.
Figure 7:
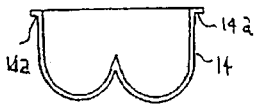
FIG. 7 is a front view of the cover.
Figure 8:
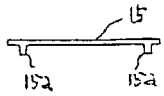
FIG. 8 is a front view of a top plate.

Preferred embodiments of the present invention will now be described with reference to the accompanying drawings.

In the accompanying drawings, reference numeral 1 denotes a watch case and 2, a watch band, respectively. One end of the wrist band 2 is fixedly attached to one end of the watch case 1. A battery 3 is received in this wrist band 2. Jacks 5, 5 provided on tip parts of electric wires 4, 4 which are electrically communicated with the battery 3 project from the other end of the wrist band 2.

An engagement part 6 having a thickness is provided on the end face of the wrist band 2 from which the jacks 5, 5 project. A loop is formed by press-engaging the engagement part 6 with respect to a counterpart of the watch case 1. The wrist band 2 is put on a target position such as, the user's wrist through this loop. The press-engagement of the engagement part 6 with respect to the counterpart of the watch case 1 causes the jacks 5, 5 to be pushed into a socket part within the watch case 1, thereby achieving an electrical connection between the battery 3 and the inside of the watch case 1.

On the upper surface side of the watch case 1, a display part 8 using, for example, a liquid crystal for indicating time, etc. is provided in such a manner as to be flush with the upper surface. On the lower surface side of the watch case 1, two vibration motors 9, 9 as a source of vibration, are provided in side by side abutment relation such that those parts generally equal to the radius projects to the outside.

A box part 11 with an opening for receiving the vibration motors 9, 9 therein is formed at a rear lid 10 which is removably attached to the clock case 1. A peripheral wall surface of the box part 11 is formed of a rubber 12 having resilient and cushioning properties. The box part 11 is provided at a top surface thereof with an intermediate lid 13.

Prior to reception into the box part 9, the vibration motors 9, 9 are received in a cover 14 having a combined shape of a deep dining tray and pack and a pack. The cover 14 is formed of a rubber. This cover 14 is generally in the shape of a letter W bent in section so that two vibrations motors 9, 9 can be set therein in intimate side by side abutment relation. A flange 14*a* is formed at an opening edge of the cover 14.

The opening of the cover 14 is closed with a rubber-made top plate 15, after the vibration motors 9, 9 are set in place. The top plate 15 is provided at a lower surface thereof with two ridges 15, 15*a* which are to be abutted with the inner surface of the opening of the cover 14 so that the cover 14 is correctly positioned. The ridges 15*a*, 15*a* are retained at external parts thereof by the flange 14*a*.

The wrist watch with a vibration function according to this embodiment is constructed in the manner as mentioned above. Although two vibrations motors 9, 9 are used in this embodiment, the present invention is not limited to this. The number of the batteries to be used may be only or three or more. Although rubber is used as a flexible material, the rubber may be replaced with other materials such as plastic, e.g., vinyl.

Operation of this embodiment will now be described. The two vibration motors 9, 9, which are surrounded by rubber and placed in side by side abutment relation such that those parts generally equal to the radius project to the outside from the clock case 1. Those projected parts are intimately pressed to a target position such as the user's wrist by resiliency and/or flexibility of the surrounding rubber. When the vibration motors 9, 9 are driven, vibrations are amplified by mutual collision and more powerfully transmitted the user. At that time, the rubber around the vibration motors 9, 9 is also vibrated in synchronism and therefore, it does not interfere the smooth vibration of the vibration motors 9, 9.

Figure 9:
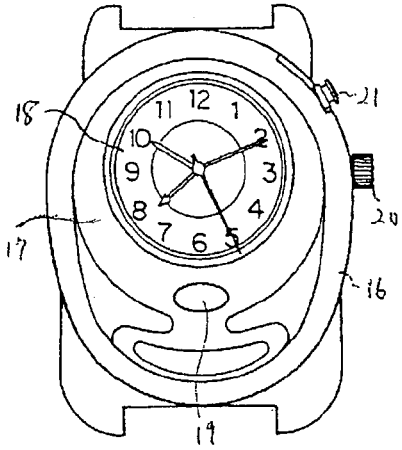
FIG. 9 is a front view showing a wrist watch with a vibration function according to the second embodiment of the present invention.
Figure 10:
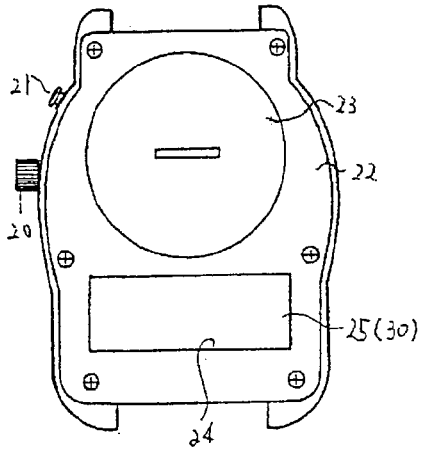
FIG. 10 is a rear view of the above.
Figure 11:
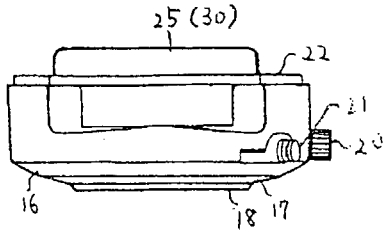
FIG. 11 is a plan view of the above.
Figure 12:
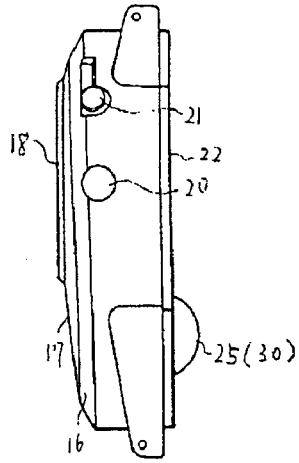
FIG. 12 is a right side view of the above.
Figure 13:
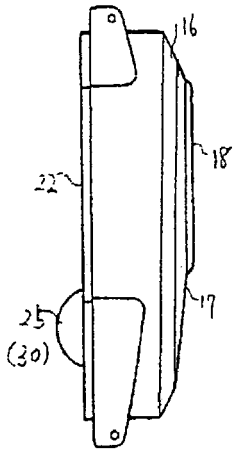
FIG. 13 is a left side view of the above.
Figure 14:
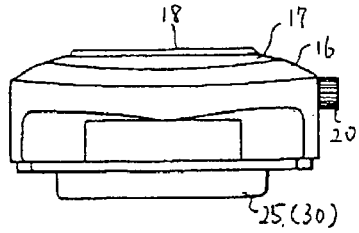
FIG. 14 is a bottom view of the above.
Figure 15:
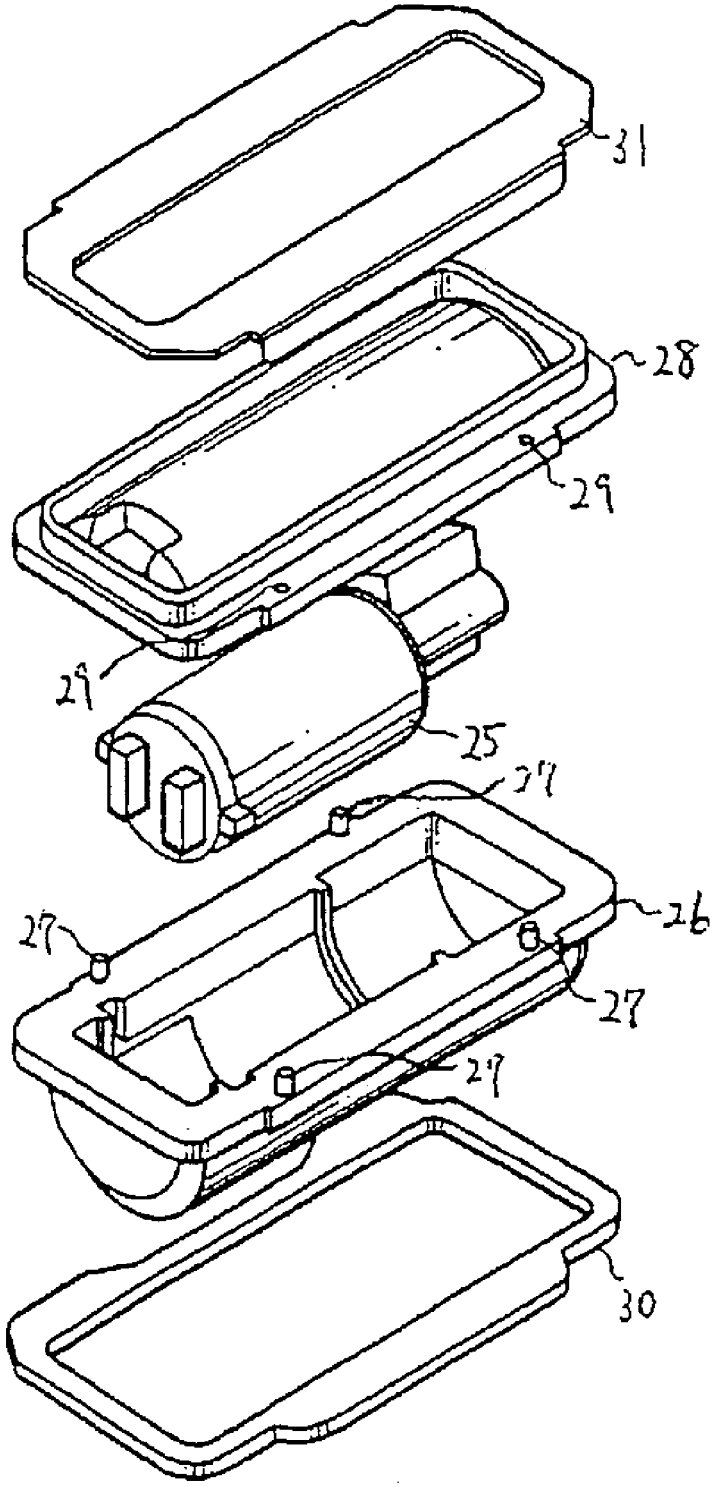
FIG. 15 is an exploded perspective view showing a receiving structure for receiving a vibration motor.

In the second embodiment shown in FIGS. 9 through 15, reference numeral 16 denotes a watch case, and 17, a cosmetic case, respectively. This cosmetic case 17 is provided at a part thereof with a rubber-made switch button 19. This switch button 19 is adapted to light up an analog type dial 18. Reference numeral 20 denotes a dragon head, and 21, a stop switch button for the vibration motors as later described, respectively.

The bottom case 22 serving as a lower surface is provided with a battery box which is open-and-closably covered with a turning lid 23. A window 24 having a rectangular configuration is formed in a lower part of the battery box. A part (about a half part) of the vibration motor 25, which is received in the case, projects from the window 24 in a loosely fitted manner, In this second embodiment, only one vibration motor 25 is used and received in a motor case 26 formed of silicon rubber. This motor case 26 has connecting pins 27 raised on a flange surface thereof. The motor case 26 is covered at the upper surface with a silicon rubber-made cushion cover case 28, and the pins 27 are fixedly fitted into pin holes 29 formed in the flange of the cushion cover case 28, thereby the motor case 26 is tightly closed.

Moreover, a lower surface of the motor case 26 is covered with a silicon rubber-made cushion packing 30. This cushion packing 30 actually serves as the projected part which is brought into abutment with the user's wrist at the time of wearing the wrist watch. The upper surface of the cushion cover case 28 is retained and supported by a stainless-made motor cover retainer 31. Owing to the construction of the second embodiment, the vibrations can be generated independently and thus, the time-related information can more precisely be informed to the user through the vibrations. Although the vibration motor is used as a vibration source in this second embodiment, the present invention is not limited to this. Other suitable vibration members may, of course, be used as the vibration source.

The wrist watch with a vibration function according to the present invention is constructed and operated in the manner as described hereinbefore. Accordingly, the vibrations can more powerfully be transmitted to the user than the related art, and consumption of electric power required for it can be reduced. Thus, the service life of the battery can be prolonged. Moreover, the vibration motor can easily be replaced and the wrist watch can easily be put on the user's wrist.

What is claimed is:

1. A wrist watch with a vibration function comprising a bottom case serving as a lower surface and having a window formed in a part thereof, a case, and a vibration source received in said case and projecting from said window in a loosely fitted state, wherein said case is made of plastic, said vibration source is received in said case, an upper surface of said vibration source is closed with a silicon rubber-made cushion cover, a lower surface of said case is closed with a silicon rubber-made cushion packing, and an upper surface of said cushion cover case is covered with a metal-made case retainer.

2. The wrist watch with a vibration function according to claim 1, wherein said vibration source is attached to a wrist band.

3. A wrist watch with a vibration function comprising a bottom case serving as a lower surface and having a window formed in a part thereof, a case, a vibration source received in said case and projecting from said window in a loosely fitted state, a wrist band and a battery as a power source received in said wrist band, said battery being electrically connected at least to said vibration source, wherein said case is made of plastic, said vibration source is received in said case, an upper surface of said vibration source is closed with a silicon rubber-made cushion cover, a lower surface of said case is closed with a silicon rubber-made cushion packing, and an upper surface of said cushion cover case is covered with a metal-made case retainer.

4. The wrist watch with a vibration function according to claim 3, wherein said vibration source is attached to said wrist band.

* * * * *